US010420424B1

(12) United States Patent
Perry

(10) Patent No.: US 10,420,424 B1
(45) Date of Patent: Sep. 24, 2019

(54) MOLDED FOAM POOL FLOAT WITH OTTOMAN

(71) Applicant: Michael L. Perry, Aledo, TX (US)

(72) Inventor: Michael L. Perry, Aledo, TX (US)

( * ) Notice: Subject to any disclaimer, the term of this patent is extended or adjusted under 35 U.S.C. 154(b) by 0 days.

(21) Appl. No.: 15/827,560

(22) Filed: Nov. 30, 2017

(51) Int. Cl.
*A47C 15/00* (2006.01)
*B63B 35/78* (2006.01)

(52) U.S. Cl.
CPC ..... *A47C 15/006* (2013.01); *B63B 35/78* (2013.01)

(58) Field of Classification Search
CPC ..... A47C 15/006; A47C 15/00; B63B 35/78
USPC ..... 441/132
See application file for complete search history.

(56) References Cited

U.S. PATENT DOCUMENTS 4,415,203 A * 11/1983 Cawley ..... A61G 15/10 297/391
4,662,852 A * 5/1987 Schneider ..... B63B 35/74 297/317
D290,108 S * 6/1987 Wolfe ..... D12/316
5,186,667 A * 2/1993 Wang ..... A47C 15/006 114/345
D350,326 S * 9/1994 Griffin ..... D12/316
6,086,150 A * 7/2000 Scheurer ..... A47C 15/006 297/219.1
6,227,925 B1 * 5/2001 Boddy ..... B63B 35/78 441/129
6,312,054 B1 * 11/2001 Scheurer ..... A47C 1/027 297/219.1
7,571,965 B1 * 8/2009 Perry ..... A47C 15/006 297/440.16
9,139,263 B2 * 9/2015 Rubey ..... B63B 35/74
2013/0267135 A1 * 10/2013 Berenson ..... B63B 35/78 441/132

* cited by examiner

*Primary Examiner* — Anthony D Wiest
(74) *Attorney, Agent, or Firm* — Mark W Handley; Handley Law Firm, PLLC

(57) ABSTRACT

A novel molded foam pool float (10) and ottoman (12) are formed of a continuous form of semi-rigid, pliable foam of constant density. The pool float (10) has an elongate shape which partially circumscribes a user, having an enclosed end (24) with a headrest (38), two arms (26, 28) symmetrically extending from opposite sides of the enclosed end (24), and an open end (30) disposed between ends (34, 36) of the arms (26, 28). The headrest (38) extends upward from the enclosed end (24), above the arms (26, 28) to provide both a headrest and a chin rest, depending upon the orientation of the pool float (10) to the user. The upper surfaces (58, 60) of the arms (26, 28) are preferably recessed beneath respective sides of the arms (26, 28) and have a pebbled texture. Void recesses (72, 74, 76) are provided in the lower side (16) of the pool float (10) for trapping air to provide enhanced flotation and reduce the unit costs of the foam for the pool float (10).

20 Claims, 2 Drawing Sheets

MOLDED FOAM POOL FLOAT WITH OTTOMAN

TECHNICAL FIELD OF THE INVENTION

The present invention relates in general to pool floats, and in particular to a pool float and ottoman formed of a semi-rigid, pliable plastic foam.

BACKGROUND OF THE INVENTION

Prior art pool floats have been provided for use in swimming pools and the like. Typically, a pool float is formed of either inflatable sections or soft foam materials to provide flotation during use. Inflatable pool floats rely on the shape of inflatable sections to provide support and buoyancy during use. Pool floats made of soft foam materials often have plastic frames or metal frames to which the soft foam is secured. Production costs for soft foam chairs with plastic and metal frames are encountered from producing the plastic frames or the metal frames, and then securing the foam to the frames. Prior art pool floats made of foam materials fixed to separately manufactured rigid frames require both manufacture of the rigid frames and the foam, and then attachment of the foam to the rigid frames for flotation.

One novel solution in the prior art is U.S. Pat. No. 7,571,965, invented by Michael L. Perry, and entitled "Molded Foam Pool Chair." The molded foam pool chair is a floating pool chair formed of a single piece of pliable foam molded to provide a rigid base portion and elastic seat portions which support a person on a water surface. The single piece of pliable foam is also molded to have a back rest, two arm rests and a foot rest. The molded foam pool chair was found to be unwieldy to transport for use and did not allow a user to be substantially submersed beneath the water surface of a pool during use.

SUMMARY OF THE INVENTION

A novel molded foam pool float and ottoman are disclosed, provided by continuous forms of semi-rigid, pliable foam material of constant density. The pool float is formed into a drawn-out, elongate shape which partially circumscribes a user, having an enclosed end with a headrest, two arms extending from opposite sides of the enclosed end, and an open end disposed between opposed terminal ends of the arms. The continuous forms of semi-rigid, pliable foam material used for the pool float is of substantially uniform thickness and cross-sectional area of sufficient thickness and width configured to prevent substantial distortion of the peripheral edge shape between unloaded and loaded conditions of the pool float and the ottoman, preferably not distorting a peripheral edge of the float more than twenty percent of a length or a width thereof. Void spaces are provided in the lower side of the pool float for trapping air to provide enhanced flotation over that of the foam and reduce the unit costs of the foam for the molded foam pool floats. The headrest is included in the portion of the continuous form providing the enclosed end, and extending upwards above an uppermost elevation of the arms with two separated arcuately shaped protuberant sections with a sloping channel extending there-between to provide both a headrest or a chin rest, depending upon the orientation of the molded foam pool float to the user. The upper surfaces of the arms are preferably recessed beneath respective sides of the arms and has a pebbled surface provided by a plurality of rounded protrusions of varying sizes extending upwardly from the upper surfaces to texture the upper surfaces. Similarly, the ottoman has a recessed top surface which is pebbled by a second plurality of rounded protrusions of varying sizes extending upwardly from the upper surface of the ottoman. Two ridges are defined by the upward terminal ends of respective ones of the sides of the pool float and extend continuously around the circumference of and protrude above adjacent ones of the upper surfaces of the arms. Similarly, a ridge is defined by the upper terminal ends of the sides of the ottoman and extends continuously around and protrudes above the top surface of the ottoman. Two cup holder recesses are formed into respective ones of the upper surfaces of the arms, one disposed close to the headrest and the other disposed close to the open end of the pool float. Flat surface regions are provided on the lower side of the pool float and the ottoman for text labels to be embossed onto the molded foam material.

DESCRIPTION OF THE DRAWINGS

For a more complete understanding of the present invention and the advantages thereof, reference is now made to the following description taken in conjunction with the accompanying Drawings in which

FIG. 1 is a perspective view of the upper side of the molded foam pool float and the topside of the ottoman;

FIG. 2 is a perspective view of the lower side of the molded foam pool float and the underside side of the ottoman;

FIG. 3 is a section view of the pool float, taken along section line 3-3 of FIG. 1;

FIG. 4 is a section view of the pool float, taken along section line 4-4 of FIG. 1; and FIG. 5 is a section view of the ottoman, taken along section line 3-3 of FIG. 1.

DETAILED DESCRIPTION OF THE INVENTION

Figure 1:
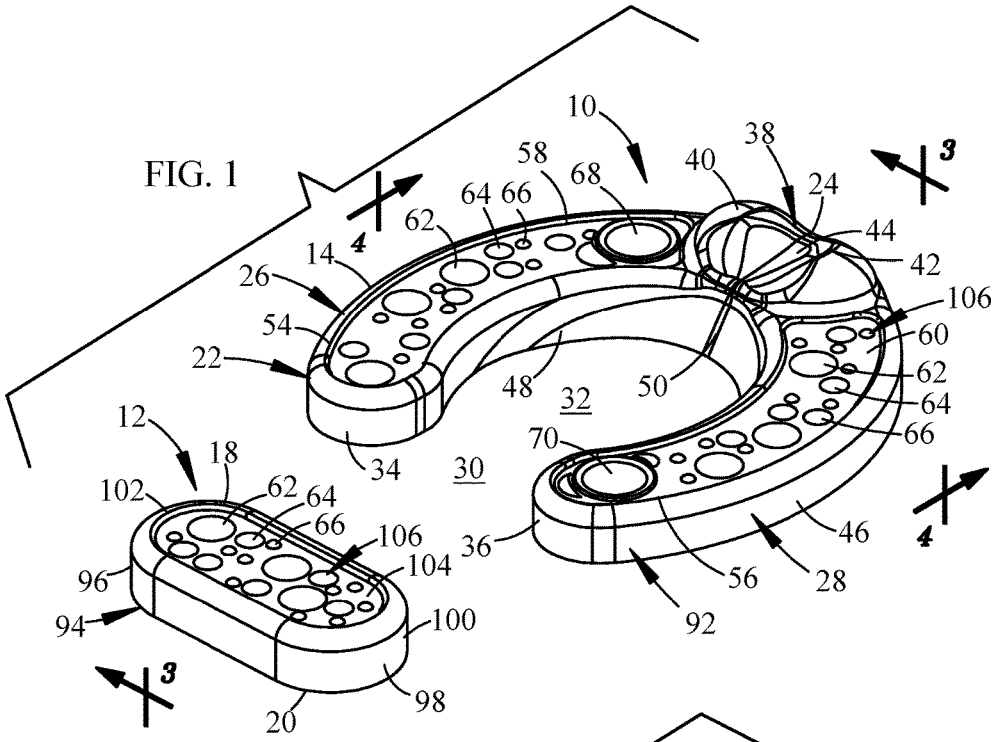
FIGS. 1 through 5 show various aspects for molded foam pool float and ottoman made according to the present invention, as set forth below.
Figure 2:
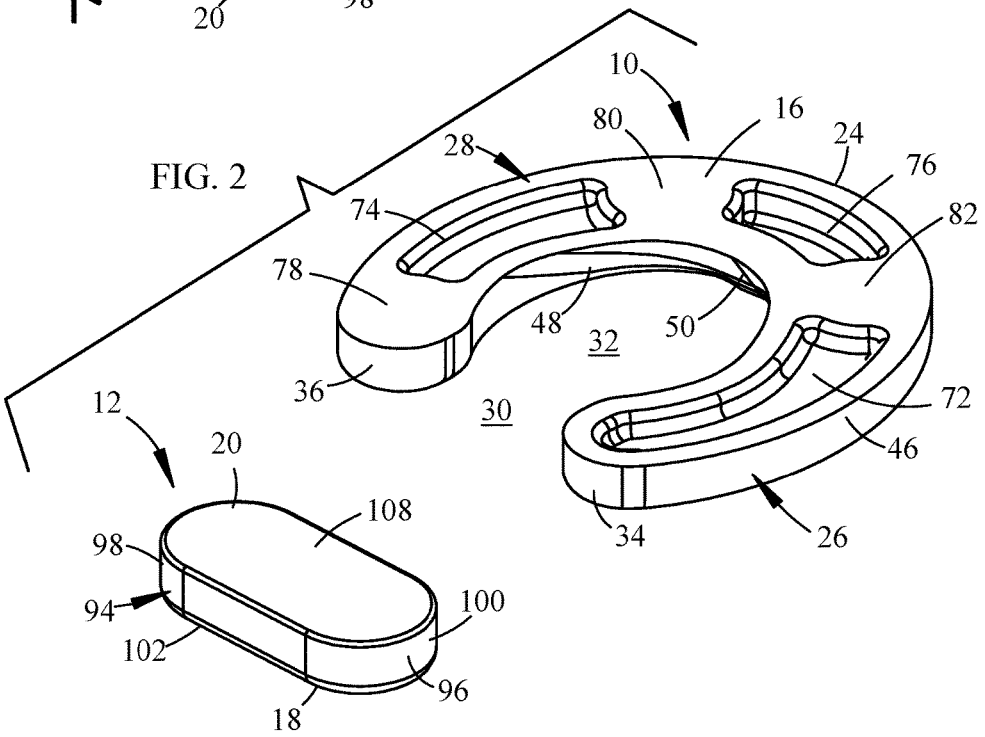

Referring to the Figures, FIG. 1 is a perspective view of an upper side 14 of a pool float 10 and a topside 18 of an ottoman 12 intended for use in a pool of water. FIG. 2 is a perspective view of the lower side 16 of the pool float 10 and underside 20 the ottoman 12. The pool float 10 is a continuous form 22 of elongate shape which preferably arcuately extends to define a semi-rigid, pliable foam open ring having an enclosed end 24, and an arm 26, an arm 28, and an open end 30. The arms 26 and 28 symmetrically extend from the enclosed end 24 to rounded terminal ends 34 and 36, respectively, which are spaced apart to together define the open end 30. The enclosed end 24, the arms 26 and 28, and the open end 30 are preferably coplanar, and partially circumscribe a centrally disposed opening 32 which is occupied by a person using the pool float 10. A headrest 38 extends upward from the enclosed end 24, centrally disposed between the two arms 26 and 28. The headrest 38 has a first rounded protuberant section 40 and a second rounded protuberant section 42 which are separated by a sloping channel 44. The sloping channel 44 provides either a headrest or a chin rest for user, depending upon the orientation of the pool float 10 to the user. A person located in the opening 32 will fit the arms 26 and 28 of the pool float around his or her torso, with his or her arms extending over the arms 26 and 28, and may either face the open end 30 using the sloping channel 44 of the headrest 38 as a headrest or face the enclosed end 24 using the sloping channel 44 of the headrest 38 as a chin rest.

The continuous form 22 of the pool float 10 has an outer side 46 and an inward side 48. The inward side 48 partially circumscribes the opening 32. A sloped portion 50 of the inward side 48 partially defines the enclosed end and defines a cross-section 52 in which the lower end slopes toward a center of the opening 32 and the upper end slopes toward the outer side 46 to provide a neck rest and upper backrest for a user when using the headrest 38 as a headrest. The outer side 46 and inward side 48 have uppermost terminal ends which define ridges 54 and 56. An upper surface 58 and an upper surface 60 are recessed in the upper side 14 of the arms 26 and 28, respectively, with the ridges 54 and 56 extending above and adjacent to respective ones of the upper surfaces 58 and 60. The ridge 54 partially extends around the upper surface 58 and the ridge 56 partially extends around the upper surface 60. The upper surfaces 58 and 60 have pebbled surfaces with texture provided by a plurality of rounded, semi-spherically shaped protuberances of various sizes, which include large protuberances 62, medium protuberances 64 and small protuberances 66. Cup holder recesses 68 and 70 are formed into respective ones of the arms 26 and 28, with cup holder recess 68 located in the arm 26 adjacent the headrest 38 and cup holder recess 70 located in the arm 28 adjacent the rounded terminal end 36. A person in the opening 32 may use the cup holder 68 when facing the enclosed end 24 and the cup holder 70 when facing the open end 30.

Figure 3:
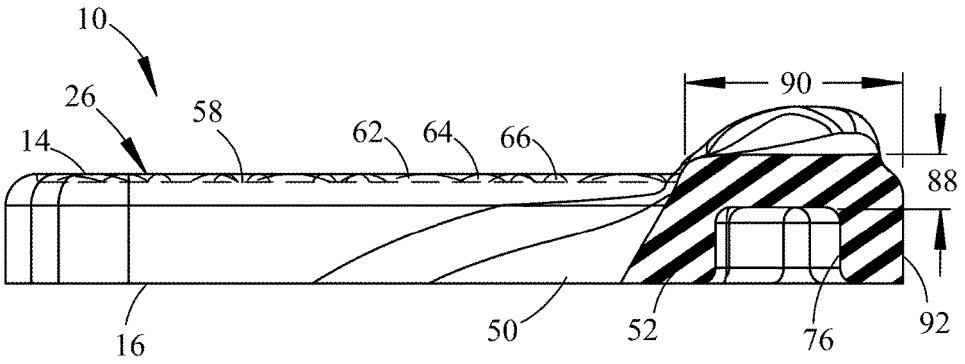
Figure 4:
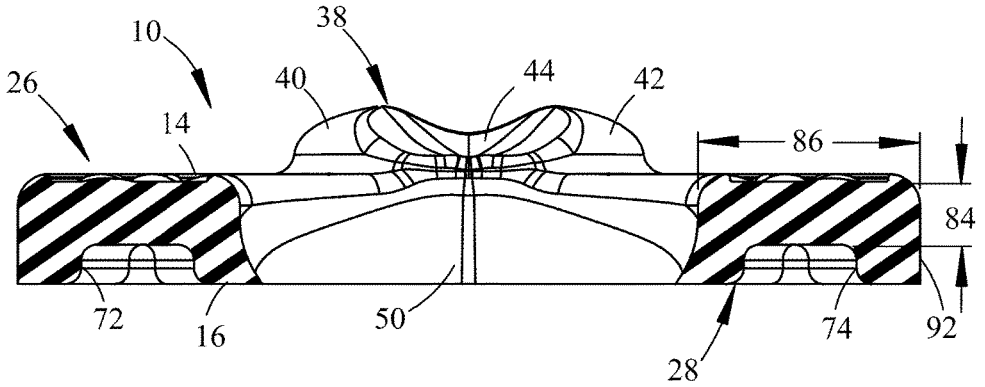

FIG. 3 is a section view of the pool float 10 taken along section line 3-3 of FIG. 1, and FIG. 4 is a section view of the pool float 10, taken along section line 4-4 of FIG. 1. A void recess 72 extends into the lower side of the arm 26. A void recess 74 extends into the lower side of the arm 28. A void recess 76 extends into the lower side of the enclosed end 24, beneath the head rest 38. The void recesses 72, 74 and 76 enhance the buoyancy of the pool float 10, removing heavy foam material and replacing the heavy foam material with air trapped in the recesses 72, 74 and 76. The cross-sections shown have a material thickness 84 and width 86 in the arms 26 and 28, and thickness 88 and width 90 in the enclosed end which are of a selected minimum size to provide sufficient stiffness or rigidity for the pool float 10 for use to support the person in the opening 32. Preferably, to provide the desired semi-rigid, yet pliable nature of the pool float 10, the thicknesses 84 and 88, and the widths 86 and 90 of the cross-sections shown are no less than four and one-half inches and no more than seven inches. This will preferably provide that a periphery 92 of the pool float 10 will not deform more than 20 percent over a length when loaded during use. Flat surface regions 78, 80 and 82 are provided in the lower side 16 for display of text or other matter embossed on or into the semi-rigid, pliable foam material.

Figure 5:
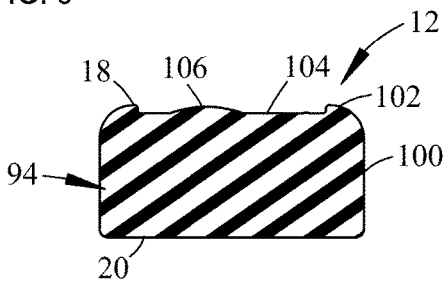

FIG. 5 is a section view of the ottoman 12, taken along section line 3-3 of FIG. 1. The ottoman 12 is provided by a second continuous form 94 of elongate shape, having rounded ends 96 and 98. Outward sides 100 of the ottoman 12 have upward ends which define a ridge 102 which extends around a top surface 104 formed into the topside 18. The top surface 104 is preferably recessed in the topside 18, extending beneath the ridge 102. The top surface 104 is textured with pebbling 106, which similar to the upper surfaces 58 and 60, has large protuberances 62, medium protuberances 64 and small protuberances defining semi-spherical shapes which protrude therefrom. The form 94 for the ottoman 12 further includes an underside with a flat surface 108 for embossing with printed matter. In use, the ottoman 12 may be placed beneath the knees of a person using the pool float 10 to float in a seated position, or beneath the feet or ankles of a user to float in a fully reclined position.

The void recesses 72, 74 and 76 are shown in FIGS. 2, 3 and 4 as being opened on the lower side 16 of the pool float 10. In other embodiments the void recesses 72,74 and 76 may be enclosed by a layer of the material forming the pool float 10 such that the void recesses 72, 74 and 76 are fully internally disposed within the float 10 and not being exposed to an exterior of the pool float 10. In other embodiments, void recesses may be formed into the ottoman 12.

The molded foam pool float 10 and the ottoman 12 are preferably a molded of closed cell foam, such as a polyolefin, a polyethylene foam, or a PVC foam. The molded closed cell foam is processed to provide a semi-rigid, pliable foam as a continuous form of a single density which is strong enough to support a user during use. Void spaces may also be provided in the closed cell foam for entrapping air to provide additional flotation. The pool chair 10 and ottoman 12 are preferably formed of compressed PVC, closed cell foam.

The present invention provides a molded foam pool float and ottoman which are formed of a continuous form of semi-rigid, pliable foam of constant density. The pool float partially circumscribes a user, having an enclosed end with a headrest, two arms symmetrically extending from opposite sides of the enclosed end, and an open end disposed between ends of the arms. The headrest extends upward from the enclosed end, above the arms to provide both a headrest and a chin rest, depending upon the orientation of the pool float to the user. The upper surfaces of the arms are preferably recessed beneath respective sides of the arms and have a pebbled texture. Void recesses are provided in the lower side of the pool float for trapping air to provide enhanced flotation and reduce the unit costs of the foam for the pool float.

Although the preferred embodiment has been described in detail, it should be understood that various changes, substitutions and alterations can be made therein without departing from the spirit and scope of the invention as defined by the appended claims.

What is claimed is:

1. A molded foam pool float providing buoyance for supporting a person in water, comprising:

a continuous form of semi-rigid, pliable foam material of constant density, having an elongate shape which partially circumscribes the person, having an enclosed end with a headrest, two arms extending from opposite sides of said enclosed end, and an open end disposed between opposed terminal ends of said arms, wherein said enclosed end, said arms and said open end are coplanar;

said headrest extending upwards above an uppermost elevation of said arms and having two separated arcuately shaped protuberant sections with a sloping channel extending there-between to provide both a headrest and a chin rest, depending upon an orientation of said molded foam pool float to the person;

said arms each having respective upper surfaces which are recessed beneath respective sides of said arms, said upper surfaces each having a plurality of rounded protrusions extending upwardly from said upper surfaces to texture said upper surfaces; and wherein two ridges are defined by upward terminal ends of respective ones of said sides of said arms, and said two ridges extend continuously around, protrude above, and define peripheries of adjacent ones of said upper surfaces of said arms.

2. The pool float according to claim 1, further in combination comprising a second continuous form of semi-rigid, pliable foam material of constant density, having an elongate shape which extends to define an ottoman for the person to use with said pool float for supporting one or more legs of the person, said ottoman having a topside and an underside, said topside having a top surface which is recessed beneath side portions of said ottoman, said side portions together having a single upper terminal end defining a ridge which extends continuously around and protrudes above said top surface of said ottoman.

3. The pool float according to claim 2, further comprising said topside of said ottoman having a second plurality of rounded protrusions extending upwardly from said top surface and providing texturing for said top surface.

4. The pool float according to claim 1, further comprising a cup holder recess formed into one of said upper surfaces of said arms.

5. The pool float according to claim 4, further comprising a second cup holder recess formed into a second one of said upper surfaces of said arms, said second cup holder recess disposed close to said headrest and said cup holder recess disposed close to said open end of said pool float.

6. The pool float according to claim 1, further comprising void recesses formed into a lower side of said pool float for trapping air and enhancing flotation.

7. The pool float according to claim 1, further comprising flat surface regions provided on a lower side of said pool float and said ottoman for labeling embossed onto said molded foam material.

8. The pool float according to claim 1, further comprising said continuous form being of a substantially uniform thickness and cross-sectional area of sufficient thickness and width configured to prevent substantial distortion of a peripheral edge shape between unloaded and loaded conditions of said pool float, such that said peripheral edge of said pool float will not distort more than twenty percent of a length or a width thereof.

9. A molded foam pool float providing buoyance for supporting a person in water, comprising:

a continuous form of semi-rigid, pliable foam material of constant density, having an elongate shape which partially circumscribes the person, having an enclosed end with a headrest, two arms extending from opposite sides of said enclosed end, and an open end disposed between opposed terminal ends of said arms, wherein said enclosed end, said arms and said open end are coplanar;

said headrest extending upwards above an uppermost elevation of said arms and having two separated arcuately shaped protuberant sections with a sloping channel extending there-between to provide both a headrest and a chin rest, depending upon an orientation of said molded foam pool float to the person;

said arms each having respective upper surfaces which are recessed beneath respective sides of said arms, said upper surfaces each having a plurality of rounded protrusions of varying sizes extending upwardly from said upper surfaces to texture said upper surfaces; and wherein two ridges are defined by upward terminal ends of respective ones of said sides of said arms, and said two ridges extend continuously around, protrude above, and define peripheries of adjacent ones of said upper surfaces of said arms.

10. The pool float according to claim 9, further in combination comprising a second continuous form of semi-rigid, pliable foam material of constant density, having an elongate shape which extends to define an ottoman for the person to use with said pool float for supporting one or more legs of the person, said ottoman having a topside and an underside which extend in parallel, said topside having a top surface which is recessed beneath side portions of said ottoman, said side portions together having a single upper terminal end defining a ridge which extends continuously around and protrudes above said top surface of said ottoman.

11. The pool float according to claim 10, further comprising said top surface of said ottoman having a second plurality of rounded protrusions of varying sizes extending upwardly from said top surface and providing texturing for said top surface.

12. The pool float according to claim 10, further comprising a cup holder recess formed into one of said upper surfaces of said arms.

13. The pool float according to claim 12, further comprising a second cup holder recess formed into a second one of said upper surfaces of said arms, said second cup holder recess disposed close to said headrest and said cup holder recess disposed close to said open end of said pool float.

14. The pool float according to claim 9, further comprising void recesses formed into a lower side of said pool float for trapping air and enhancing flotation.

15. The pool float according to claim 9, further comprising flat surface regions provided on a lower side of said pool float and said ottoman for labeling embossed onto said molded foam material.

16. The pool float according to claim 9, further comprising said continuous form being of a substantially uniform thickness and cross-sectional area of sufficient thickness and width configured to prevent substantial distortion of a peripheral edge shape between unloaded and loaded conditions of said pool float, such that said peripheral edge of said pool float will not distort more than twenty percent of a length or a width thereof.

17. The pool float according to claim 9, wherein said elongate shape of said continuous form of semi-rigid, pliable foam material of constant density has sufficient thicknesses and widths configured to define structural foam cross-sectional areas of said pliable foam material to prevent substantial distortion of an outer peripheral edge shape between unloaded and loaded conditions of said molded foam pool float;

said structural foam cross-sectional area defined to prevent distortion of said length and said width of edges of said continuous form of not substantially more than twenty percent;

said continuous form of said pliable foam material has a cross-sectional area with thicknesses and widths of not substantially more than seven inches; and said pliable foam material is a closed cell foam, and said continuous form of said pliable foam material has a cross-sectional area with thicknesses and widths which are not substantially less than four and one-half inches.

18. A molded foam pool float and ottoman providing buoyance for supporting a person in water, comprising:

a continuous form of semi-rigid, pliable foam material of constant density, having an elongate shape which partially circumscribes the person, having an enclosed end with a headrest, two arms extending from opposite sides of said enclosed end, and an open end disposed between opposed terminal ends of said arms, wherein said enclosed end, said arms and said open end are coplanar;

said headrest extending upwards above an uppermost elevation of said arms and having two separated arcuately shaped protuberant sections with a sloping channel extending there-between to provide both a headrest and a chin rest, depending upon an orientation of said molded foam pool float to the person;

said arms each having respective upper surfaces which are recessed beneath respective sides of said arms, said upper surfaces each having a plurality of rounded protrusions of varying sizes extending upwardly from said upper surfaces to texture said upper surfaces;

wherein two ridges are defined by upward terminal ends of respective ones of said sides of said arms, and said two ridges extend continuously around, protrude above, and define peripheries of adjacent ones of said upper surfaces of said arms;

a second continuous form of semi-rigid, pliable foam material of constant density, having an elongate shape which extends to define an ottoman for the person to use with said pool float for supporting one or more legs of the person, said ottoman having a topside and an underside which extend in parallel, said topside having a top surface which is recessed beneath side portions of said ottoman, said side portions together having a single upper terminal end defining a ridge which extends continuously around and protrudes above said top surface of said ottoman;

said top surface of said ottoman having a second plurality of rounded protrusions of varying sizes extending upwardly from said topside and providing texturing for said top surface.

19. The pool float according to claim 18, further comprising a first cup holder recess formed into one of said upper surfaces of said arms, and a second cup holder recess formed into a second one of said upper surfaces of said arms, said second cup holder recess disposed close to said headrest and said cup holder recess disposed close to said open end of said pool float.

20. The pool float according to claim 19, further comprising void spaces formed into a lower side of said pool float for trapping air and enhancing flotation, and flat surface regions provided on said lower side of said pool float and said ottoman for labeling embossed onto said molded foam material.

* * * * *